US005804361A

United States Patent [19]

Suzuki

[11] Patent Number: 5,804,361

[45] Date of Patent: Sep. 8, 1998

[54] SILVER HALIDE PHOTOGRAPHIC EMULSION

[75] Inventor: Tetsuya Suzuki, Hino, Japan

[73] Assignee: Konica Corporation, Japan

[21] Appl. No.: 677,440

[22] Filed: Jul. 2, 1996

[30] Foreign Application Priority Data

Jul. 4, 1995 [JP] Japan ..... 7-168842

[51] Int. Cl.[6] ..... G03C 1/035; G03C 1/015

[52] U.S. Cl. ..... 430/567; 430/569

[58] Field of Search ..... 430/567, 569

[56] References Cited

U.S. PATENT DOCUMENTS

| | | | |
|---|---|---|---|
| 4,386,156 | 5/1983 | Mignot | 430/567 |
| 5,169,750 | 12/1992 | Vacca | 430/569 |
| 5,565,315 | 10/1996 | Yamashita | 430/567 |
| 5,605,790 | 2/1997 | Nimura et al. | 430/569 |
| 5,637,446 | 6/1997 | Yamashita | 430/567 |
| 5,652,089 | 7/1997 | Saitou | 430/567 |

*Primary Examiner*—Mark F. Huff

*Attorney, Agent, or Firm*—Jordan B. Bierman; Bierman, Muserlian and Lucas

[57] ABSTRACT

A silver halide photographic emulsion comprising silver halide grains is disclosed, in which at least 50% of the total grain projected area is accounted for by tabular grains having a chloride content of 50 mol % or more and two parallel {100} major faces and the tabular grains are formed by causing seed grains to grow, the seed grains being tabular grains having a bromide content of 50 mol % or more, two parallel {100} major faces and an aspect ratio of 2.0 or more.

9 Claims, No Drawings

SILVER HALIDE PHOTOGRAPHIC EMULSION

FIELD OF THE INVENTION

The present invention is related to a silver halide emulsion.

BACKGROUND OF THE INVENTION

It is well known in the art that the use of tabular silver halide grains in a photographic light sensitive material leads to improvements in spectral sensitivity, covering power, sharpness, graininess, etc. On the other hand, it is also known that they cause problems in that they are liable to result in defects in pressure resistance, such as abrasion marks and kinking marks, which may be due to the grain form.

Recently, tabular silver halide grains having parallel twin planes have widely been employed. The tabular grains have major faces comprising {111} face, a hexagonal or triangular form, based on the lattice structure of the a {111} face. On the other hand, in cases when a large amount of a sensitizing dye is adsorbed to silver halide grains, silver halide grains having a {100} face are superior in sensitivity, so that development of tabular grains having major faces comprising the {100} face is desired.

A preparation method of tabular grains having major faces comprising a {100} face which are parallel to each other and having an aspect ratio 1.5 to 7 is disclosed in U.S. Pat. No. 4,063,951. A silver halide emulsion comprised of silver bromide tabular grains having major faces comprising two parallel (100) faces and an aspect ratio of 8 or more, and a preparation method thereof are disclosed in U.S. Pat. No. 4,386,156. According to these disclosures, it is shown that these tabular grain emulsions increase contrast and enhance a maximum density, as compared to an emulsion comprised of cubic grains comprising a {100} face.

However, the use of these emulsions resulted in silver images with color tone which was not clear but was tinted yellowish black, not pure black. Therefore, in the case when these emulsions of silver halide photographic light sensitive material are used for medical purposes, in which the silver image is directly observed, it gives an unpleasant impression to observers and/or diagnosticians.

Recently, processing with automatic processors has rapidly spread, with further increased market demand for rapid processing of photographic light sensitive materials. As is generally known, the use of silver halide grains having a high content of silver chloride with ionic crystallinity is preferable for rapid processing of photographic light sensitive materials. However, the silver chloride is liable to be fogged and is low in sensitivity, which is undesirable for use in a silver halide photographic light sensitive material for medical use, in which high sensitivity is required so as to reduce adverse effects on the human body as much as possible. With regard to silver chloride containing tabular grains, U.S. Pat. No. 5,275,930 discloses a technique in which silver halide containing silver chloride of 50 mol % or more is epitaxially grown on tabular grains with an aspect ratio of 8 or more and a {100} major face; and U.S. Pat. No. 5,314,798 discloses silver iodochloride tabular grains containing 50 mol % or more chloride with an aspect ratio of 8 or more and (100) major faces. These emulsions are low in sensitivity and in cases when they are employed in a sheet film such as a photographic light sensitive material for medical use, the photographic material is handled directly by hands so that it is often creased to result in blackening, often referred to as pressure fogging. This defect is afraid to make a faulty diagnosis. Accordingly, a silver halide photographic light sensitive material excellent in rapid processing and improved in pressure blackening has be desired particularly in the field of medical service.

SUMMARY OF THE INVENTION

The present invention was made in view of the foregoing circumstances. Thus, an object of the present invention is to provide a silver halide photographic emulsion which is suitable for a silver halide photographic light sensitive material for medical use, excellent in color tone of silver images and rapid-processability and improved in pressure mark (blackening)

The above object of the invention can be accomplished by a silver halide photographic emulsion in which at least 50% of the total grain projected area is accounted for tabular silver halide grains contain 50 mol % or more chloride and having two parallel {100} major faces, which are prepared by growing seed crystal grains substantially consisting of tabular silver halide grains containing 50 mol % or more bromide and having two parallel {100} major faces and an aspect ratio of 2 or more;

said tabular seed crystal silver halide grains having a mean ratio of a mean grain diameter to a mean grain thickness of 3.0 or less;

said tabular seed crystal grains being subjected to reduction sensitization before subjecting to desalinization washing; and said silver halide photographic emulsion being subjected to calcogen sensitization.

DETAILED DESCRIPTION OF THE INVENTION

As afore-described, the advantage of the tabular grains is that enhancement in spectral sensitizing efficiency and improvements in graininess and sharpness of images are achieved, as disclosed in British Patent No. 2,112,157 and U.S. Pat. Nos. 4,439,520, 4,433,048, 4,414,310, 4,434,226, 4,414,310 and 4,434,226.

The tabular grains are herein defined as those having two substantially parallel crystal faces, each of which is substantially larger than any other single crystal face of the grain. These two parallel faces are hereinafter referred to as major faces. The term "substantially parallel" as used herein is intended to include surfaces that appear parallel on direct or indirect inspection by electron-microscopy. The tabular silver halide grains of the invention each have two major faces lying in {100} crystal faces.

The tabular silver halide grains have a mean grain size of 0.3 to3.0 $\mu$m, preferably 0.5 to 2.2 $\mu$m. The word, "mean grain size" refers to a mean value of edge lengths of the major faces of the tabular grains.

In the present invention, the edge length of the major face of a tabular silver halide grain is defined as an edge length of a square equivalent to the projected area of the tabular grain, based on electronmicrograph.

The tabular grains may exhibit square or rectangular major faces characteristic of {100} crystal faces. The major faces of tabular grains of the invention have a mean edge ratio (i.e., ratio of a longer edge to a shorter edge) of 1 to 1.4, preferably 1 to 1.3.

The tabular silver halide grains of the invention have a mean value of an aspect ratio of an edge length to thickness of 2.0 or more, preferably 2.0 to 40.0, more preferably 4.0 to 30.0. To determine the mean aspect ratio, at least 100 samples are subjected to measurement.

The tabular grains of the invention have a mean thickness of 0.5 mm or less, preferably 0.3 μm or less.

In the invention, the thickness of the tabular grains is defined as a minimum distance between two substantially parallel crystal faces, each of which is substantially larger than any other single crystal face. Thus, the thickness is a distance between the major faces.

The thickness of the tabular silver halide grains can be determined from an electronmicrograph of shadowed silver halide grains or section of a photographic material sample.

A process for preparing a silver halide emulsion used in the invention is roughly divided into a process of preparing seed crystal grains and a process including growth of the seed grains. The process of preparing the seed grains comprises a grain forming step including nucleation and ripening to form seed grains, followed by desalination washing step. The process including seed grain growth comprises a step of causing the seed grains to grow to form final grains, desalination washing step and subsequent step including chemical sensitization etc.

The seed grain emulsion used in the invention comprises tabular grains containing 50 mol % or more, preferably 65 mol % or more, more preferably 80 mol % more bromide, and having {100} major faces and an aspect ratio of not less than 2.0 and not more than 50.

A tabular grain emulsion of the invention comprises tabular grains having {100} major faces, which have been prepared by causing the seed grains above-described to grow, and containing 50 mol % or more, preferably 60 mol % or more and more preferably 70 mol % or more chloride. The tabular grains account for 50% or more preferably 70%, and more preferably 80% or more of the total projected area of the grains.

A ratio of mean thickness of the final tabular grains (b) to mean thickness of the tabular seed grains (a), i.e., b/a is preferably 3.0 or less, more preferably 0.3 to 2.8 and furthermore preferably 0.7 to 2.6.

The tabular rains relating to the invention may comprise, besides {100} faces, a {111} or {110} face.

The tabular grain emulsion is preferably monodispersed. A coefficient of variation of the edge lengths of the major faces (i.e., grain sizes) is preferably 30% or less, more preferably20% or less. A monodispersed tabular grain emulsion with a different mean edge length of the major faces, a polydispersed tabular grain emulsion, a cubic, octahedral or tetradecahedral regular crystal emulsion or a twin crystal emulsion may be blended in an amount not so as to lower effects of the invention.

In the invention, the coefficient of variation of the grain size (edge length of the major face) is defined as a standard deviation of the grain size divided by a mean grain size and multiplied by 100 (%).

The tabular grains of the invention may be those having uniform halide composition within the grain, or those containing iodide internally or in the vicinity of the grain surface. The tabular contains preferably iodide of less than 2 mol % and not less than 0.01 mol %, more preferably, less than 1 mol % and not less than 0.1 mol %.

Preparation methods of the tabular grain emulsion are referred to U.S. Pat. Nos. 4.063,951, 4,386,156, 5,275,930, and 5,314,798.

The size and configuration of the tabular grains can be controlled by a temperature, pAg (pBr, pCl), pH or flowing rates of silver salt and halide solutions at the time of the grain formation.

The pAg at the time of forming the tabular grains of the invention is 4.0 to 9.0.

The iodide content of the tabular silver halide emulsion can be controlled by varying the composition of a halide solution to be added, that is, the proportion of chloride, bromide and iodide.

A silver halide solvent, such as ammonia, thioether or thiourea may optionally added at the time of forming grains.

The above-mentioned emulsion may be surface latent image forming type, internal latent image forming type or type of forming internal and surface latent images. Among these emulsions, are preferable a surface latent image forming emulsion. In the preparation of these emulsions, an iron salt, cadmium salt, lead salt, thallium salt, ruthenium salt, osmium salt, iridium salt, or rhodium salt or their complex salt.

The emulsion may be subjected to noodle washing or flocculation washing to remove soluble salts. As preferred washing methods are cited a technique of using aromatic hydrocarbon aldehyde resin containing a sulfo group described in Japanese Patent examined No. 35-16086 and polymeric coagulating agents, G3, G8, etc. described in JP-A 63-158644.

In the preparation of a silver halide emulsion, it is advantageous to employ gelatin as a protective colloid used in a dispersion medium or a binder of a hydrophilic colloidal layer; however, another hydrophilic colloid may be advantageously usable. As examples thereof are cited a gelatin derivative, graft polymer of gelatin and another polymer, protein such as albumin or casein, cellulose derivative such as hydroxyethyl cellulose, carboxymethyl cellulose or cellulose sulfuric acid ester, sodium alginate, saccharide derivative such as a starch derivative, polymer such as polyvinyl alcohol and partial acetal thereof, poly-N-vinyl pyrrolidone polyacrylic acid, polymethaacrylic acid, polyacrylamide, polyvinyl imidazole or polyvinyl pyrazole, and copolymer thereof.

As gelatin is usable lime-treated gelatin, acid-treated gelatin, enzyme-treated gelatin described in Bull. Soc. Sci. Phot. Japan, No. 16, page 30 (1966), or hydrolysis product or enzymatic process product from gelatin. In the preparation of a silver halide emulsion of the invention, it is advantageous to employ a gelatin having a low methionine content of less than 30 μmol per g of gelatin, preferably, less than 12 μmol per g of gelatin, as disclosed in U.S. Pat. No. 4,713,323.

A silver halide emulsion of the invention is chemically sensitized. As noble metal sensitization is preferable gold sensitization, in which a gold compound or gold complex such as gold-thiocyanate is used as a sensitizer. Besides gold, complex salts of noble metals including platinum, iridium, Osmium, palladium, rhodium and ruthenium are also usable.

Gold sensitizers include a chloroaurate, gold-thiourea complex salt, potassium chloroaurate, auric trichloride, potassium auric thiocyanate, potassium iodoaurate, tetracyanoauric amide, ammonium aurothiocyanate and pyridyltrichlorogold. The addition amount thereof is variable, depending on conditions such as the pH, temperature and silver halide grain size, however, it is preferably $5\times10^{-7}$ to $5\times10^{-3}$ and more preferably, $2\times10^{-6}$ to $4\times10^{-4}$ mol per mol of silver halide.

The emulsion may be subjected to calcogen sensitization, preferably, sulfur sensitization. Selenium sensitization and tellurium sensitization are also preferably employed.

Sulfur sensitizers include, for example, a thiosulfate, allylthiocarbamide, thiourea, allyl isothiocyanate, cystine, p-toluenethiosulfate and rhodanine. Further, there can be employed sulfur sensitizers as described in U.S. Pat. Nos. 1,574,944 and 3,656,955, German patent No. 1,422,869, Japanese Patent examined 56-24937 and JP-A 55-45016. The sulfur sensitizer is added in an amount enough to enhance effectively sensitivity of a silver halide emulsion. The addition amount is variable, depending on conditions such as the pH, temperature and silver halide grain size, however, it is preferably $5\times10^{-8}$ to $5\times10^{-5}$.

As a selenium sensitizer is usable compounds known in the art.

According to the invention, a silver halide emulsion is selenium-sensitized with a selenium compound. Thus, a labile selenium compound and/or non-labile selenium compound is added to the emulsion, which is further maintained at a high temperature for a period of time with stirring.

There is preferably employed a labile selenium compound as disclosed in Japanese Patent examined No. 44-15748 and 43-13489 and JP-A 2-130976. As examples of labile selenium sensitizers are cited isoselenocyanates (e.g., an aliphatic isoselenocyanate such as allylisoselenocyanate), selenoureas, selenoketones, selenoamides, selenocarboxylic acids (e.g., 2-selenopropionic acid, 2-selenobutylic acid), selenoesters, diacylselenides (e.g., bis-3-chloro-2,6-dimethoxybenzoylselenide), selenophosphates, phosphine selenides and colloidal elemental selenium.

Labile selenium compounds are not limited to the above-described compounds.

A non-labile selenium compound is also usable as a selenium sensitizer, as disclosed in Japanese Patent examined Nos. 46-4553, 52-34491/1977 and 52-34492/1977. As examples thereof are cited selenious acid, potassium selenocyanate, selenazoles and quaternary ammonium salt thereof, diarylselenide, diaryldiselenide, dialkylselenide, dialkyldiselenide, 2-selenazolidinedione, 2-selenooxazolidinedione and derivative thereof. Selenium compounds preferably used in the invention are shown below.

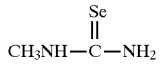
(1)

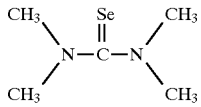
(2)

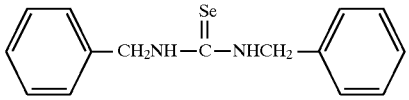
(3)

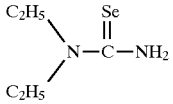
(4)

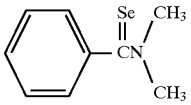
(5)

-continued

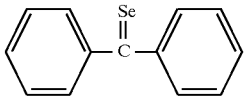
(6)

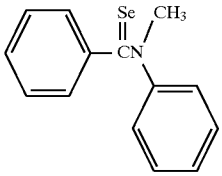
(7)

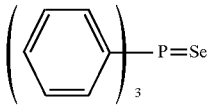
(8)

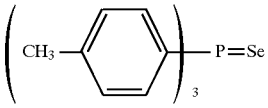
(9)

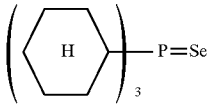
(10)

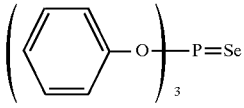
(11)

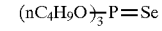
(12)

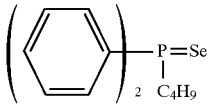
(13)

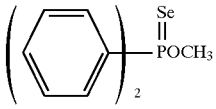
(14)

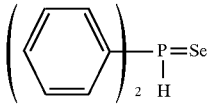
(15)

The amount of a selenium sensitizer to be used, which is dependent on a selenium compound to be used, silver halide grains and chemical sensitizing condition is generally $1\times10^{-8}$ mol or more per mol of silver halide and preferably $1\times10^{-6}$ to $1\times10^{-3}$ mol per mol of silverhalide. The selenium sensitized may be dissolved in water or a organic solvent such as methanol or ethanol to be added; or mixed with a aqueous gelatin solution to be added. The sensitized may be added in the form of a dispersion of a mixture solution of an organic solvent-soluble polymer, as disclosed in JP-A 4-140739.

As tellurium sensitizers are usable compounds described in U.S. Pat. No. 3,772,031, British Patent 235,211, Canadian Patent 800,958, J. Chem. Soc. Chem. Commun., 635 (1980), ibid 1102 (1979), ibid 645 (1979), and J. Chem. Soc. Perkin Trans. 1, 2191 (198).

Examples of the tellurium sensitizer include colloidal tellurium, telluroureа (e.g., allyltellurourea, N,N-dimethyltellurourea, tetramethyltellurourea, N-carboxyethyl-N', N'-dimethyltellurourea, N,N'-dimethylethylenetellurourea, N,N'-diphenylethylenetellurourea), isotellurocyanates (e.g., allylisotellurocyanate), telluroketones (e.g., telluroacetone, telluroacetophenone), telluroamides (e.g., telluroacetoamide, N,N-dimethyltellurobenzamide), tellurohydrazide (e.g., t-butyl-t-hexyltelluroester), phosphinetellurides (e.g., tributylphosphinetelluride, tricyclohexylphosphinetelluride), triisopropylphosphinetelluride, butyl-diisopropylphosphinetelluride, dibutylphenylphosphinetelluride) and other tellurium compounds (e.g., gelatin containing a negative-charged telluride ion described in British Patent 1,295,462, potassium telluride, potassium tellurocyanate, sodium telluropentathionate, allyltellurocyanate).

Among these compounds, a compound represented by the following formula (I) or (II) is preferably used.

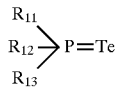

Formula (I)

In the formula, $R_{11}$, $R_{12}$ and $R_{13}$ each represent an aliphatic group, aromatic group, heterocyclic group, $OR_{14}$, $NR_{15}$ $(R_{16})$,$SR_{17}$, $OSiR_{18}(R_{19})$ $(R_{20})$, X or hydrogen atom. $R_{14}$ and $R_{17}$ each represent an aliphatic group, aromatic group, heterocyclic group, hydrogen atom or cation; $R_{18}$, $R_{19}$ and $R_{20}$ each represent an aliphatic group; and X represents a halogen atom.

In Formula (I), an aliphatic group represented by $R_{11}$, $R_{12}$, $R_{13}$, $R_{14}$, $R_{15}$, $R_{16}$ $R_{17}$, $R_{18}$, $R_{19}$, and $R_{20}$ has preferably 1 to 30 carbon atoms, and more preferably a branched, unbranched or cyclic alkyl group having 1 to 20 carbon atoms, alkenyl group, alkynyl group, aralkyl group. Examples of the alkyl group, alkenyl group, alkynyl group and aralkyl group include methyl, ethyl, n-propyl, isopropyl, t-butyl, n-octyl, n-decyl, n-hexadecyl, cyclopentyl, cyclohexyl, allyl, butenyl, 3-pentenyl, propargyl, 3-pentynyl, benzyl and phenethyl. In Formula (I), an aromatic group represented by $R_{11}$, $R_{12}$, $R_{13}$, $R_{14}$, $R_{15}$, $R_{16}$ and $R_{17}$ has preferably 6 to 30 carbon atoms; and are more preferably monocyclic or condensed aryl group having 6 to 20 carbon atoms, such as phenyl or naphthyl.

In Formula (I), a heterocyclic group represented by $R_{11}$, $R_{12}$, $R_{13}$, $R_{14}$, $R_{15}$, $R_{16}$ and $R_{17}$ is a saturated or unsaturated heterocyclic group containing at least one of nitrogen, oxygen and sulfur atoms and 3 to 10 carbon atoms. These may be monocyclic or condensed with an aromatic or heterocyclic ring. A 5 or 6-member aromatic heterocyclic group is more preferable, including pyridyl, furyl, thienyl, thiazolyl, imidazolyl, and benzimidazolyl. In Formula (I), a cation represented by $R_{14}$ and $R_{17}$ represents, for example, an alkali metal ion or ammonium ion. IN formula (I), a halogen atom represented by X includes a fluorine atom, chlorine atom, bromine atom or iodine atom. The aliphatic group, aromatic group and the heterocyclic group may be substituted. Examples of substituents include an alkyl group, aralkyl group, alkenyl group, alkynyl group, aryl group, alkoxy group, aryloxy group, amino group, acylamino group, ureido group, urethane group, sulfonylamino group, sulfamoylamino group, carbamoyl group, sulfonyl group, sulfinyl group, alkyloxycarbonyl group, aryloxycarbonyl group, acyl group, acyloxy group, phosphoric acid amido group, diacylamino group, imido group, alkylthio group, arylthio group, halogen atom, cyano group, sulfo group, carboxy group, hydroxy group, phosphono group, nitro group and heterocyclic group. These groups each may be substituted. In the case where substituents are two or more, the substituents may be the same or different from each other.

$R_{11}$, $R_{12}$ and $R_{13}$may combine with each other to form a ring with a phosphorus atom; and $R_{15}$ and $R_{16}$ combine with each other to form a nitrogen-containing ring. In Formula (I), $R_{11}$, $R_{12}$ and $R_{13}$ each are preferably an aliphatic group or aromatic group, more preferably an alkyl group or aromatic group.

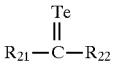

Formula (II)

In the formula, $R_{21}$, represents an aliphatic group, aromatic group, heterocyclic group or —$NR_{23}$ $(R_{24})$; $R_{22}$ represents —$NR_{25}$ $(_{26})$ N $(R_{27})$—$N(R_{28})R_{29}$ or —$OR_{30}$. $R_{23}$, $R_{24}$, $R_{25}$, $R_{26}$, $R_{27}$, $R_{28}$, $R_{29}$ and $R_{30}$ each represent a hydrogen atom, aliphatic group, aromatic group, heterocyclic group, or acyl group, in which $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ may combine with each other to form a ring.

In the formula, an aliphatic group represented by $R_{21}$, $R_{23}$, $R_{24}$, $R_{25}$, $R_{26}$, $R_{27}$, $R_{28}$, $R_{29}$ and $R_{30}$ has preferably 1 to 30 carbon atoms, and more preferably a branched, unbranched or cyclic alkyl group having 1 to 20 carbon atoms, alkenyl group, alkynyl group, aralkyl group. Examples of the alkyl group, alkenyl group, alkynyl group and aralkyl group include methyl, ethyl, n-propyl, isopropyl, t-butyl, n-octyl, n-decyl, n-hexadecyl, cyclopentyl, cyclohexyl, allyl, butenyl, 3-pentenyl, propargyl, 3-pentynyl, benzyl and phenethyl. An aromatic group represented by $R_{21}$, $R_{23}$, $R_{24}$, $R_{25}$, $R_{26}$, $R_{27}$, $R_{28}$, R29 and $R_{30}$ has preferably 6 to 30 carbon atoms; and are more preferably monocyclic or condensed aryl group having 6 to 20 carbon atoms, such as phenyl or naphthyl.

A heterocyclic group represented by $R_{21}$, $R_{23}$, $R_{24}$, $R_{25}$, $R_{26}$, $R_{27}$, $R_{28}$, $R_{29}$ and $R_{30}$ is a saturated or unsaturated heterocyclic group containing at least one of nitrogen, oxygen and sulfur atoms and 3 to 10 carbon atoms. These may be monocyclic or condensed with an aromatic or heterocyclic ring. A 5 or 6-member aromatic heterocyclic group is more preferable, including pyridyl, furyl, thienyl, thiazolyl, imidazolyl, and benzimidazolyl. An acyl group represented by $R_{23}$,$R_{24}$, $R_{25}$, $R_{26}$, $R_{27}$, $R_{28}$, $R_{29}$ and $R_{30}$ has preferably 1 to 30 carbon atoms, more preferably being branched or unbranched acyl group having 1 to 20 carbon atoms, such as formyl, acetyl, benzoyl, pivaloyl and decanoyl. In the case when forming a ring, $R_{21}$ and $R_{25}$, $R_{21}$ and R27, $R_{21}$ and $R_{28}$, $R_{21}$ and $R_{30}$, $R_{23}$ and $R_{25}$, $R_{23}$ and $R_{27}$, $R_{23}$ and $R_{28}$, and $R_{23}$ and $R_{30}$ combine with each other to form a ring, through, an alkylene group, arylene group, aralkyl group or alkenylene group, etc.

The aliphatic group, aromatic group and heterocyclic group above-mentioned may be substituted by a substituent which is cited in Formula (I). In Formula (II), $R_{21}$ is preferably an aliphatic group, aromatic group or —$NR_{23}$ $(R_{24})$, and $R_{22}$ is preferably —$N(R_{25}$ $(R_{26})$. $R_{23}$, $R_{24}$, $R_{25}$ and $R_{26}$ is preferably an aliphatic or aromatic group. More preferably, $R_{21}$ is an aromatic group or —$NR_{23}$ $(R_{24})$, and $R_{22}$ is —$NR_{25}$ $(R_{26})$. $R_{23}$, $R_{24}$, $R_{25}$ and $R_{26}$ is preferably an alkyl group or aromatic group. In the case when forming a ring, $R_{21}$ and $R_{25}$, and $R_{23}$ and $R_{25}$ preferably combine with each other, through an alkylene group, arylene group, aralkylene group or alkenylene group, to form a ring.

Exemplary compounds represented by Formula (I) and (II) are shown as below.

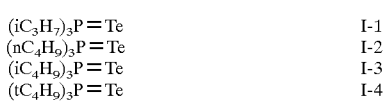

$(iC_3H_7)_3P{=}Te$ I-1
$(nC_4H_9)_3P{=}Te$ I-2
$(iC_4H_9)_3P{=}Te$ I-3
$(tC_4H_9)_3P{=}Te$ I-4

-continued

I-5 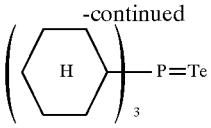

I-6 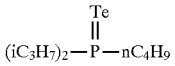

I-7 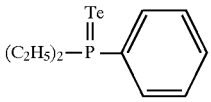

I-8 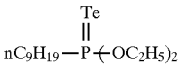

I-9 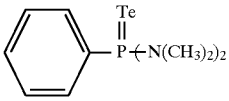

I-10 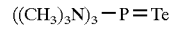

I-11 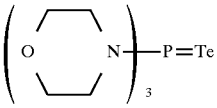

II-1 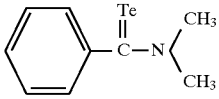

II-2 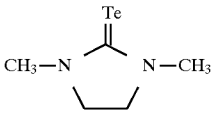

II-3 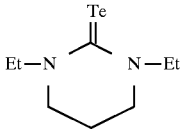

II-4 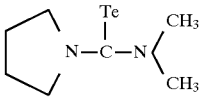

II-5 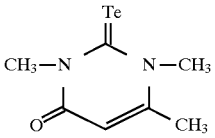

II-6 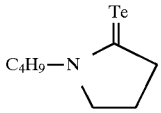

The compound represented by Formula (I) or (II) can be synthesized according to a known method, as described in J. Chem. Soc. (A), 1969, 2927; J. Organome. Chem., 4, 320 (1965); ibid., 1, 200 (1963); ibid., 113, C35 (1976); Phosphorus Sulfur, 15, 155 (1983); Chem. Ber., 109, 2996 (1976); J. Chem. Soc. Chem. Commun., 635 (1980); ibid., 1102 (1976); ibid., 645 (1979); ibid., 820 (1987); J. Chem. Soc. Perkin. Trans., 1, 2191 (1980); The Chemistry of Organo Selenium and Tellurium Compounds Vol. 2, page 216–267 (1987).

Addition amount of the tellurium sensitizer depends on silver halide grains and chemical ripening conditions, and generally $10^{-8}$ to $10^{-2}$, preferably $10^{-7}$ to $5\times10^{-3}$ mol per mol of silver halide. Chemical-sensitizing conditions are not limitative but the pAg is 6 to 11, preferably 7 to 10, and the temperature is 4° to 95° C., preferably 45° to 60° C.

A seed crystal grain emulsion used in the invention is preferably subjected to reduction sensitization during the course of forming the emulsion and before being subjected to desalting (alternatively, desalination washing). As preferable reduction sensitizers are cited thiourea dioxide, ascorbic acid and its derivatives, hydrazine, polyamines such as diethylenetriamine, dimethylamine boranes and sulfites.

The addition amount of the reduction sensitizer depends on kind of the reduction sensitizer, grain size, halide composition and crystal habit of silver halide grains and reaction conditions such as temperature, pH and pAg. In case of thiourea oxide, for example, the addition of 0.01 to 2 mg per mol of silver halide leads to preferred results. In case of ascorbic acid, it is 50 mg to 2 g per mol of silver halide.

The emulsion can be reduction-sensitized under reducing environment, such as a high pH (pH 5–11), or low pAg (pAg 1–6). Thus, as the condition for reduction sensitization are preferable a temperature of 40° to 70° C., a period of 5 to 200 min., pH Of 5 to 11 and pAg of 1 to 6.

The emulsion can be reduction-sensitized by adding a water soluble silver salt to lower pAg. As the water soluble silver salt is preferable silver nitrate, and the pAg at ripening is 1 to 6, preferably 2 to 4.

A stabilizer may be used for reduction-sensitized silver halide emulsions singly or in combination with an antioxidant described in JP-A 57-82831 or thiosulfinic acid described in V.S. Gahler, "Zeitschrift fur wissenschaftlishe Photographie" Bd.63, 133 (1969) and JP-A 54-1019.

The silver halide emulsion of the invention can be spectrally sensitized. As spectral sensitizing dyes are usable conventional methine dyes, including cyanine dyes, merocyanine dyes, complex cyanine dyes, complex merocyanine dyes, holopolar cyanine dyes, hemicyanine dyes, styryl dyes and hemioxonol dyes. As examples thereof are cited oxacarbocyanines, benzoimidazolocarbocyanines and benzoimidazolooxacarbocyanines described in Japanese Patent application No. 3-95310. A dye capable of sensitizing in the blue region is also usable, as described in JP-A 6-332102. These dyes may be used singly or in combination thereof.

The dye is dissolved in an organic solvent such as methanol to be added. The addition amount is 10 to 900 mg, preferably 60 to 400 mg per mol of silver halide. The sensitizing dye is preferably added before completing chemical ripening, wherein the dye may be added dividedly. More preferably, the dye is added after the completion of grain growth and before the completion of chemical ripening, and furthermore preferably, the dye is added before starting chemical ripening. To stop chemical sensitization (i.e., chemical ripening), it is preferable to use a stopping agent for chemical ripening. As the stopping agent are cited halides (e.g., potassium bromide, sodium chloride), antifoggant and stabilizer, such as 4-hydroxy-6-methyl-1,3,3s,7-tetrazaindene. These compounds may be used singly or in combination.

In a silver halide emulsion used in the invention, various additives may be incorporated in physical ripening, or before, during or after chemical ripening. As the additives, can be employed compounds as described in aforementioned RD Nos. 17643, 18716 and 308119, wherein relevant types of compounds and sections thereof are follows.

| Additive | RD-17643 Page | RD-17643 Sec. | RD-18716 Page | RD-308119 Page | RD-308119 Sec. |
|---|---|---|---|---|---|
| Chemical sensitizer | 23 | III | 648 upper right | 996 | III |
| Sensitizing dye | 23 | IV | 648–649 | 996–8 | IVA |
| Desensitizing dye | 23 | V | | 998 | IVB |
| Dye | 25–26 | VII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Antistatic agent | 27 | XII | 650 right | 1006–7 | XIII |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XVII | | 1003–4 | IX |
| Support | 28 | XVII | | 1009 | XVII |

Next, Processing of a photographic light sensitive material related to the invention will be described. As a developing agent used in a developer are cited dihydroxybenzenes (hydroquinone etc.), p-aminophenol (p-aminophenol, N-methyl-p-aminophenol, 2,4-diaminophenol etc.), 3-pyrazolidones (1-phenyl-3-pyrazolidone, 1-phenyl-4-methyl-4-hydroxymethyl-3-pyrazolidone, 5,5-dimethyl-1-phenyl-3-pyrazolidone etc.), as described in JP-A 4-15641 and 4-16841. The using amount of p-aminophenols and 3-pyrazolidones is preferably 0.004 mol/l or more, more preferably 0.04 to 0.12 mol/1. The total amount of dihydroxybenzenes, p-aminophenols and 3-pyrazolidones contained in a developer is preferably 0.1 mol/l or more.

Sulfites (potassium sulfite, sodium sulfite etc.) of reductons (piperidinohexose reductone etc.) may be contained as a preservative, in an amount of 0.2 to 1 mol/l (preferably, 0.3 to 0.6 mol/l). A large amount of ascorbic acid may be added for stabilization of processing.

An alkali agent may be contained for adjusting a pH, such as sodium hydroxide, potassium hydroxide, sodium carbonate, potassium carbonate, sodium phosphate and potassium phosphate. Further, borates described in JP-A 61-28708 and saccharose described in JP-A 60-93439, acetoxime, 5-sulfosalicylic acid, phosphates and carbonates may be usable. These compounds are selected so as to make pH 9.0 to 13, preferably 10 to 12.5.

Polyethylene glycols and its ester, as a dissolving aid quaternary ammonium salt as sensitizer, a developing accelerator and surfactant may be contained.

As an antislugging agent are preferably employed an anti-silver-staining agent described JP-A 56-106244, sulfide and disulfide compounds described in JP-A 3-51844, cysteine derivatives described in JP-A 5-289255 and a triazine compound.

As an organic restrainer are usable azole type organic antifoggants including indazoles, imidazoles, benzimidazoles, triazoles, benztriazoles, tetrazoles and thiadiazoles. As a inorganic restrainer are usable sodium bromide, potassium bromide and potassium iodide. Further, compounds described in L.F.A. Mason, "Photographic Processing Chemistry" published by Focal Press (1966), page 226–229; U.S. Pat. Nos. 2,193,015 and 2,592,364, and JP-A 48-64933 may be used.

As a chelating agent for sequestering calcium ions contained in tap water used in processing solutions, a chelating agent having achelate stabilization constant with iron of 8 or more, as described in 1-193853 is preferably used. As a inorganic chelating agent are usable sodium hexametaphosphate, calcium hexametaphosphate and polyphosphate.

As a developer-hardening agent may be used aldehyde hardening agents. Particularly, glutar aldehyde is preferably used. However, it is preferable for rapid processing to have the hardening contained in a photographic material rather than in a developer.

Developing temperature is preferably 25° to 50° C., more preferably 30° to 40° C. Developing time is 3 to 90 sec. preferably 5 to 60 sec. Total processing time (Dry to Dry) is 15 to 90 sec., preferably 15 to 50 sec.

Replenishing of a processing solution is made in correspondence with exhaustion of processing agents and exhaustion by oxidation. Replenishing is made in a manner described in JP-A 55-126243, 60-104946 and 1-149156. The replenishing rate is preferably 150 to 500 cc/$m^2$.

A fixer may contain materials used in conventional fixers. The pH of the fixer is 3.8 or more, preferably 4.2 to 5.5. A fixing agent is preferably thiosulfates including ammonium thiosulfate and sodium thiosulfate and ammonium thiosulfate is more preferable from the point of fixing speed. The concentration of ammonium thiosulfate is preferably 0.1 to 5 mol/l, more preferably 0.8 to 3 mol/l. The fixer may contain a hardener. As the hardener is preferable a compound containing an aluminum ion, such as aluminum sulfate, aluminum chloride and potassium alum. The fixer may optionally contain a preservative such as a sulfite or bisulfite, a pH buffer such as acetic acid or boric acid, a pH-adjusting agent including various acids such as mineral acid (sulfuric acid, nitric acid), organic acid (citric acid, oxalic acid, malic acid etc.) and hydrochloric acid and metal hydroxide (potassium hydroxide, sodium) and a chelating agent capable of water-softening. As a fixing accelerator are cited thiourea derivatives described in Japanese Patent examined 45-35754, 58-122535 and 58-122536 and thioether described in U.S. Pat. No. 4,126,459.

As supports used in the photographic material of the invention are cited those described in afore-mentioned RD-17643, page 28 and RD-308119, page 1009.

As an optimal support is cited polyethylene terephthalate film. The surface of the support may be sub-coated or exposed to corona discharge or UV-ray.

EXAMPLES

Embodiments of the present invention will be exemplarily explained further in detail, but the invention is not limited thereto.

Preparation of seed emulsion (SD-1)

Solution A1

To 2000 g of gelatin was added water to make 10 l.

Solution B1

To 850 g of silver nitrate was added water to make 5 l.

Solution C1

To 595 g of potassium bromide and 4 g of potassium iodide was added water to make 5 l.

Solution A1 was adjusted to a pH of 6.2 in a reaction vessel, while maintaining at 40° C. with stirring. Solutions B1 and C1 were added thereto by double jet method over a period of 1 min. After completing the addition, the pAg and pH of the reaction mixture were 7.0 and 6.2, respectively. Then the temperature was increased to 65° C. and the mixture was further hold over a period of 60 min., while the pAg and pH were maintained at 6.8 ad 6.2.

Using an aqueous solution of Demol (product by Kao-Atlas) and aqueous solution of magnesium sulfate, the emulsion was subjected to washing to remove soluble salts.

Then gelatin was further added and the emulsion was cooled. According to the observation with a scanning electronmicroscope, the resulting emulsion was comprised of silver iodobromide tabular grains containing 99.5 mol % bromide and having an aspect ratio of 8.2, mean edge length of 0.49 μm, variation coefficient of edge length of 25%, mean grain thickness of 0.06 μm and square {100} major faces. The emulsion was referred to as seed emulsion SD-1.

Preparation of seed emulsion (SD-2)

Solution A2

To 600 g of gelatin was added water to make 30 l.

Solution B2

To 75 g of silver nitrate was added water to make 475 ml.

Solution C2

To 56 g of potassium bromide and 0.38 g of potassium iodide was added water to make 475 ml.

Solution A2 was adjusted to a pH of 6.2 in a reaction vessel, while maintaining at 40° C. with stirring. Solutions B2 and C2 were added thereto by double jet method over a period of 30 sec. After completing the addition, the pAg and pH of the reaction mixture were 7.4 and 6.2, respectively. Then the temperature was increased to 65° C. and the mixture was further hold over a period of 60 min., while the pAg and pH were maintained at 6.7 ad 6.2.

Using an aqueous solution of Demol (product by Kao-Atlas) and aqueous solution of magnesium sulfate, the emulsion was subjected to washing to remove soluble salts. Then gelatin was further added and the emulsion was cooled. According to the observation with a scanning electronmicroscope, the resulting emulsion was comprised of silver iodobromide tabular grains containing 99.5 mol % bromide and having an aspect ratio of 6.1, mean edge length of 0.55 μm, variation coefficient of edge length of 22%, mean grain thickness of 0.09 μm and square {100} major faces. The emulsion was referred to as seed emulsion SD-2.

Preparation of seed emulsion SD-3

A seed emulsion SD-3 was prepared in the same manner as in seed emulsion SD-1, except that, in place of increasing a temperature of the reaction mixture to 65° C. and holding for 60 min. with stirring, the mixture was maintained at 65° C. for 45 min., further hold at pH of 9.0 for 20 min., and thereafter the pH was adjusted to 6.2. According to the observation with a scanning electronmicroscope, the resulting emulsion was comprised of silver iodobromide tabular grains containing 99.5 mol % bromide and having an aspect ratio of 9.2, mean edge length of 0.55 μm, variation coefficient of edge length of 22%, mean grain thickness of 0.06 μm and square {100} major faces. The emulsion was referred to as seed emulsion SD-3.

Preparation of emulsion Em-1

Solution A3

To 350 g of oxidized gelatin, 3.27 g of sodium chloride and 0.25 g of potassium iodide was added water to make 10 l.

Solution B3

To 770 g of silver nitrate was added water to make 9.1 l.

Solution C3

To 266 g of sodium chloride was added water to make 9.1 l.

Solution A3 was adjusted to a pH of 6.2 in a reaction vessel and seed emulsion SD-1 (equivalent to 0.49 mol %) was added thereto, while maintaining at 40° C. with stirring. Solutions B3 and C3 were simultaneously added thereto at a flowing rate of 40 ml/min. by taking 40 min. and then further added at a flowing rate of 80 ml/min. by double jet method, taking 95 min. During the addition, the pCl of the mixture was maintained at 2.45 with 0.5N sodium chloride aqueous solution, and the pH was 6.1. After completing the addition, 100 g of phthalated gelatin was added.

Using an aqueous solution of Demol (product by Kao-Atlas) and aqueous solution of magnesium sulfate, the emulsion was subjected to washing to remove soluble salts. Then gelatin was further added and the emulsion was cooled. According to the observation with a scanning electronmicroscope, the resulting emulsion was comprised of silver iodobromochloride tabular grains having a chloride content of 90.20 mol %, a mean edge length of 1.93 μm, variation coefficient of edge length of 30%, mean grain thickness of 0.08 μm and square {100} major faces, and accounting for 85% of the projected area of total grains. The emulsion was referred to as emulsion Em-1.

Preparation of emulsion Em-2

Emulsion Em-2 was prepared in the same manner as in emulsion Em-1, except that solution A3 was replaced by the following solution A4.

Solution A4

To 350 g of oxidized gelatin, 3.27 g of sodium chloride and 0.5 g of potassium iodide was added water to make 10 l.

According to the observation with a scanning electronmicroscope, the resulting emulsion was comprised of silver iodobromochloride tabular grains having a chloride content of 90.18 mol %, a mean edge length of 1.65 μm, variation coefficient of edge length of 27%, mean grain thickness of 0.11 μm and square {100} major faces, and accounting for 85% of the projected area of total grains. The emulsion was referred to as emulsion Em-1.

Preparation of emulsion Em-3

Emulsion Em-3 was prepared in the same manner as in emulsion Em-1, except that solution A3 was replaced by the following solution A5.

Solution A5

To 350 g of oxidized gelatin, 3.27 g of sodium chloride and 0.7 g of potassium iodide was added water to make 10 l.

According to the observation with a scanning electronmicroscope, the resulting emulsion was comprised of silver iodobromochloride tabular grains having a chloride content of 90.15 mol %, a mean edge length of 1.41 μm, variation coefficient of edge length of 27%, mean grain thickness of 0.15 μm and square {100} major faces, and accounting for 83.5% of the projected area of total grains. The emulsion was referred to as emulsion Em-3.

Preparation of emulsion Em-4

Emulsion Em-3 was prepared in the same manner as in emulsion Em-1, except that solution A3 was replaced by the following solution A6.

Solution A6

To 350 g of oxidized gelatin, 3.27 g of sodium chloride and 0.9 g of potassium iodide was added water to make 10 l.

According to the observation with a scanning electronmicroscope, the resulting emulsion was comprised of silver iodobromochloride tabular grains having a chloride content of 90.13 mol %, a mean edge length of 1.22 μm, variation coefficient of edge length of 25%, mean grain thickness of 0.20 μm and square {100} major faces, and accounting for 83.0% of the projected area of total grains. The emulsion was referred to as emulsion Em-4.

Emulsions Em-5 to Em-8 were prepared in the same manner as in emulsions Em-1 to Em-4, respectively, except that seed emulsion SD-1 was replaced by seed emulsion SD-2. Emulsions Em-9 to Em-12 were prepared in the same manner as in emulsions Em-1 to Em-4, respectively, except that seed emulsion SD-1 was replaced by seed emulsion SD-3. Characteristics of the resulting emulsions Em-1 to Em-12 are summarized in Table 1.

Chemical ripening:

To each of the these emulsions kept at 60° C., a sensitizing dye (5,5'-dichloro-1,1', 3,3'-tetraethylbenzimidazolocarbocyanine) of 0.7 mmol per mol of silver halide was added in the form of a solid particle dispersion. After 10 min. was added a mixture solution of ammonium thiocyanate of 95 mg, chloroauric acid of 2.5 mg and sodium thiosulfate of 2.0 mg, each per mol of silver halide, and in case of selenium sensitization was added triphenylphosphineselenide of 0.2 mg per mol of silver halide. In case of tellurium sensitization, an equivalent amount of exemplified sensitizer I-1 was added. After 30 min., a silver iodide fine grain emulsion of $4.0\times10^{-3}$ per mol of silver halide and the emulsion was further ripened over a total time of 2 hrs. After completion of chemical ripening, 280 mg of 4-hydroxy-6-methyl-1,3,3a, 7-tetrazaindene (TAI) was added thereto. The solid particle dispersion of the sensitizing dye was prepared by adding a given amount of the dye into water kept at 27° C. and stirring with a high-speed stirrer (dissolver) at 3500 rpm over a period of 30 to 120 min. Chemically riped emulsions each were shown in Table 1, wherein letters, "S", "Se" and "Te" referred to sulfur sensitization, selenium sensitization and tellurium sensitization, respectively.

A dispersion of triphenylphosphineselenide was prepared in the following manner. Triphenylphosphineselenide of 120 g was dissolved in 30 kg of ethylacetate maintained at 50° C., and mixed with a gelatin aqueous solution in which 3.8 kg of gelatin was dissolved in 38 kg of water, together with 93 g of 25% by weight sodium dodecylbenzenesulfonate aqueous solution. The mixture was dispersed at 50° C. using a high-speed stirring machine having a dissolver with 10 cm in diameter, at 40 m/sec. over a period of 30 min. The resulting dispersion was stirred to remove ethyl acetate under reduced pressure until the residual amount of ethyl acetate reached 0.3% by weight. Thereafter, the dispersion was diluted with water to make 80 kg.

Preparation of coating solutions and Coating

Emulsion layer coating solution

| | |
|---|---|
| 1,1-Dimethylol-1-brom-1-nitromethane | 70 mg |
| t-Butyl-catechol | 400 mg |
| 2,6-Vis)hydroxyamino)-4-diethylamino-1,3,5-triazine | 0.15 mg |
| Polyvinyl pyrrolidone (M.W., 10,000) | 1.0 g |
| Stylene-anhydrous maleic acid copolymer | 2.5 g |
| Nitrophenyl-triphenylphosphonium chloride | 50 mg |
| Ammonium 1,3-dihydroxybenzene-4-sulfonate | 2.0 g |

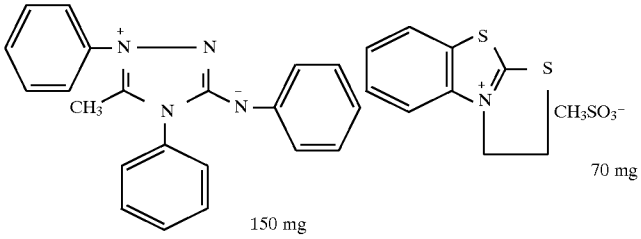

| | |
|---|---|
| $C_4H_9OCH_2CH(OH)CH_2N(CH_2COOH)_2$ | 2 g |
| 1-Phenyl-5-mercaptotetrazole | 15 mg |

Filter layer coating solution

Into an aqueous dispersion containing a copolymer (10% by weight) comprising three kinds of monomers of glycidylmethaacrylate (50 mol %), methylacrylate (10 mol %) and butylmethaacrylate (40 mol %) were dispersed the following filter dye of 20 g and gelatin of 200 g.

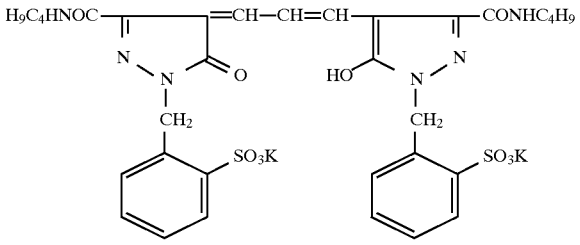

Protective layer coating solution

| | |
|---|---|
| Lime-treated gelatin | 68 g |
| Acid-treated gelatin | 2 g |
| Sodium i-amyl-n-decylsulfosuccinate | 1 g |
| Polymethylmethaacrylate (matting agent, area-averaged particl size of 1.2 μm) | 1.1 g |
| Silicon dioxide (matting agent, area-averaged particle size of 1.2 μm) | 0.5 g |
| $(CH_2{=}CHSO_2CH_2)_2O$ (hardener) | 500 mg |
| $C_4F_9SO_3K$ | 2 mg |

-continued

| | |
|---|---|
| $C_{12}H_{25}CONH(CH_2CH_2O)_5H$ | 2.0 g |
| 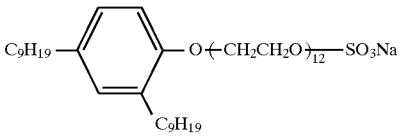 | 1.0 g |
| 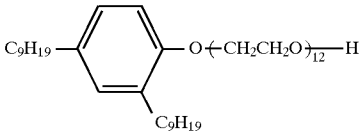 | 0.4 g |
| 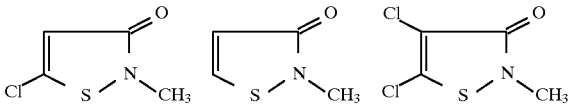 | (50:46:4) 0.1 g |

These coating solutions were coated on both sides of a 175 μm blue-tinted (density:0.20) polyethylene terephthalate film support, in the order of a filter layer, emulsion layer and protective layer from a support, so as to have a silver coverage of 1.3 g/m$^2$ and and gelatin amount of 1.3 g/m$^2$ (protective layer, 0.8 g/m$^2$; emulsion layer, 1.5 g/m$^2$; filter layer, 0.2 g/m$^2$), each per one side, using two slide-hopper type coating machine at a coating speed of 120 m/min., and dried for 2 min. 20 sec. to prepare samples No. 1 to 28.

Sensitometry (Evaluation of phtographic characteristics)

A photographic material sample was laminated with two intensifying screen sheets (SRO-250, product of Konica Corp.) and exposed, through an aluminium wedge, to X-ray emitted at 60 kvp of bulb voltage and 100 mA of bulb current for 0.064 sec. Exposed samples were precessed with the following developer and fixer, using a roller transport type automatic processor (product by Konica), which was further modified so as to be capable of 25 sec.-processing. A sensitivity was expressed as reciprocal of exposure necessary for giving a density of fog plus 1.0. The sensitivity (herein after, denoted as S) was shown as a relative value, based on the sensitivity of Sample 1 being 100.

Developer

| Part-A (for 12 liter) | |
|---|---|
| Potassium hydroxide | 600 g |
| Potassium sulfite (50% aq. solution) | 2180 g |
| Diehtylenetetraaminepentaacetic acid | 100 g |
| Sodium bicarbonate | 240 g |
| 5-Methylbenztriazole | 1.2 g |
| 1-Phenyl-5-mercaptotetrazole | 0.2 g |
| 1-phenyl-4-hydroxymethyl-4methyl-3-pyrazolidone | 200 g |
| Boric acid | 250 g |
| hydroquinone | 340 g |
| Water to make | 5000 ml |
| Part B (for 12 liter) | |
| Glacial acetic acid | 170 g |
| triethylene glycol | 324 g |
| 1-Phenyl-3-pyrazolidone | 21.6 g |
| N-Acetyl-D,L-penicillamine | 2.4 g |

To water of 5 liter were added Part-A and Part-B and water was further added to make 12 liter. The pH was adjusted to 10.60 with KOH, and glacial acetic acid of 2.5 g/l and potassium bromide of 7.9 g/l were added thereto, thereafter, the pH was adjusted to 10.45 with KOH to make a working solution.

Fixer (for 12 liter)

| | |
|---|---|
| Water | 2600 g |
| Sodium sulfite | 450 g |
| Boric acid | 108 g |
| Acetic acid (90%) | 450 g |
| β-alanine | 1620 g |
| 1-(N,N-dimethylamino)-ethyl-5-mercaptotetrazole | 18 g |
| Ammonium thiosulfate (70 wt/vol %) | 6000 g |

The pH of finish solution was adjusted to 4.35 and water was added to make 18 liters, as a working solution.

Photographic material samples each were overall exposed in an exposure amount that gave a density of 1.0 and 2000 pieces (10×12 inch size) of each sample were continuously processed so as to reach stationary state in processing. Each sample was processed with processing solutions at the stationary level. The developer and fixer were replenished in amounts of 200 cc/m$^2$ and 190 cc/m$^2$, respectively. The temperature of developing, fixing, washing and drying was respectively 35° C., 33° C., 20° C. and 50° C.

Evaluation of pressure resistance

Photographic material samples with a size of 13×35mm were allowed to stand at 23° C. and 42% RH for 1 hour. The samples each were bent in a radius of curvature of 4 mm and then processed without exposure. A difference between a density produced by bending and a fog density was denoted as ΔD, which referred to a measure of pressure fogging. The smaller this value is, the better the pressure resistance.

Evaluation of image tone

Each sample was subjected to photographing of a chest phantom at a bulb voltage of 90 Kvp using X-ray intensifying screen, SRO-250 (product by Konica Corporation), followed by processing. Silver image tone of processed samples was observed on a viewing lantern and visually evaluated based on the following criteria.

1: Yellowish black tone

2: Slightly yellowish black tone

3: Reddish black tone

4: Slightly reddish black tone

5: Neutral black tone

In the above grades, grade 1 is outside of practical use, and grades of 4 or more are preferable for practical use.

Results are shown in Table 2. As can be seen therefrom, the present invention led to a silver halide emulsion excellent in silver image tone and rapid-processability, and improved in pressure resistance.

TABLE 1

| | Seed emulsion | | | Emulsion | | | | | | | |
|---|---|---|---|---|---|---|---|---|---|---|---|
| | | | | | Tablar grains | | | | | | Grain |
| Sample No. | Emulsion No. | Grain thickness a (μm) | Red. Sensiti-zation | Emulsion No. | Size (μm) | Thickness b (μm) | Aspect ratio | Chloride content (mol %) | Tablar grain ratio (%) | Chemical ripening | thickness ratio b/a |
| 1 | SD-1 | 0.06 | No | Em-1 | 1.93 | 0.05 | 24.1 | 90.20 | 85.0 | S | 1.33 |
| 2 | SD-1 | 0.06 | No | Em-2 | 1.65 | 0.11 | 15.0 | 90.18 | 85.0 | S | 1.83 |
| 3 | SD-1 | 0.06 | No | Em-3 | 1.41 | 0.15 | 9.4 | 90.15 | 83.5 | S | 2.50 |
| 4 | SD-1 | 0.06 | No | Em-4 | 1.22 | 0.20 | 6.1 | 90.13 | 83.0 | S | 3.33 |
| 5 | SD-2 | 0.09 | No | Em-5 | 1.72 | 0.10 | 17.2 | 90.20 | 88.2 | S | 1.11 |
| 6 | SD-2 | 0.09 | No | Em-6 | 1.51 | 0.13 | 11.6 | 90.18 | 87.5 | S | 1.44 |
| 7 | SD-2 | 0.09 | No | Em-7 | 1.37 | 0.16 | 8.6 | 90.15 | 87.3 | S | 1.78 |
| 8 | SD-2 | 0.09 | No | Em-8 | 1.14 | 0.23 | 5.0 | 90.13 | 87.0 | S | 2.56 |
| 9 | SD-3 | 0.06 | Yes | Em-9 | 2.02 | 0.07 | 28.9 | 90.20 | 86.0 | S | 1.17 |
| 10 | SD-3 | 0.06 | Yes | Em-10 | 1.68 | 0.11 | 15.3 | 90.18 | 85.0 | S | 1.83 |
| 11 | SD-3 | 0.06 | Yes | Em-11 | 1.43 | 0.15 | 9.5 | 90.15 | 83.0 | S | 2.50 |
| 12 | SD-3 | 0.06 | Yes | Em-12 | 1.24 | 0.20 | 6.2 | 90.13 | 83.0 | S | 3.33 |
| 13 | SD-2 | 0.09 | No | Em-5 | 1.72 | 0.10 | 17.2 | 90.20 | 88.2 | S + Se | 1.11 |
| 14 | SD-2 | 0.09 | No | Em-6 | 1.51 | 0.13 | 11.6 | 90.18 | 87.5 | S + Se | 1.44 |
| 15 | SD-2 | 0.09 | No | Em-7 | 1.37 | 0.16 | 8.6 | 90.15 | 87.3 | S + Se | 1.78 |
| 16 | SD-2 | 0.09 | No | Em-8 | 1.14 | 0.23 | 5.0 | 90.13 | 87.0 | S + Se | 2.56 |
| 17 | SD-3 | 0.06 | Yes | Em-9 | 2.02 | 0.07 | 28.9 | 90.20 | 86.0 | S + Se | 1.77 |
| 18 | SD-3 | 0.06 | Yes | Em-10 | 1.68 | 0.11 | 15.3 | 90.18 | 85.0 | S + Se | 1.83 |
| 19 | SD-3 | 0.06 | Yes | Em-11 | 1.43 | 0.15 | 9.5 | 90.15 | 83.0 | S + Se | 2.50 |
| 20 | SD-3 | 0.06 | Yes | Em-12 | 1.24 | 0.20 | 6.2 | 90.13 | 83.0 | S + Se | 3.33 |
| 21 | SD-2 | 0.09 | No | Em-5 | 1.72 | 0.10 | 17.2 | 90.20 | 88.2 | S + Te | 1.11 |
| 22 | SD-2 | 0.09 | No | Em-6 | 1.51 | 0.13 | 11.6 | 90.18 | 87.5 | S + Te | 1.44 |
| 23 | SD-2 | 0.09 | No | Em-7 | 1.37 | 0.16 | 8.6 | 90.15 | 87.3 | S + Te | 1.78 |
| 24 | SD-2 | 0.09 | No | Em-8 | 1.14 | 0.23 | 5.0 | 90.13 | 87.0 | S + Te | 2.56 |
| 25 | SD-3 | 0.06 | Yes | Em-9 | 2.02 | 0.07 | 28.9 | 90.20 | 86.0 | S + Te | 1.17 |
| 26 | SD-3 | 0.06 | Yes | Em-10 | 1.68 | 0.11 | 15.3 | 90.18 | 85.0 | S + Te | 1.83 |
| 27 | SD-3 | 0.06 | Yes | Em-11 | 1.43 | 0.15 | 9.5 | 90.15 | 83.0 | S + Te | 2.50 |
| 28 | SD-3 | 0.06 | Yes | Em-12 | 1.24 | 0.20 | 6.2 | 90.13 | 83.0 | S + Te | 3.33 |

TABLE 2

| Sample | Photographic performance | | | Image | Pressure resistance |
|---|---|---|---|---|---|
| No. | Fog | S | Dmax | Tone | (ΔD) |
| 1 | 0.03 | 100 | 3.50 | 5 | 0.08 |
| 2 | 0.03 | 100 | 3.37 | 5 | 0.06 |
| 3 | 0.03 | 97 | 3.33 | 5 | 0.05 |
| 4 | 0.06 | 85 | 3.15 | 4 | 0.05 |
| 5 | 0.03 | 105 | 3.60 | 5 | 0.07 |
| 6 | 0.03 | 105 | 3.52 | 5 | 0.06 |
| 7 | 0.03 | 102 | 3.45 | 5 | 0.06 |
| 8 | 0.03 | 99 | 3.30 | 5 | 0.04 |
| 9 | 0.01 | 135 | 3.62 | 5 | 0.09 |
| 10 | 0.01 | 135 | 3.52 | 5 | 0.07 |
| 11 | 0.01 | 130 | 3.45 | 5 | 0.06 |
| 12 | 0.09 | 112 | 3.20 | 4 | 0.06 |
| 13 | 0.01 | 140 | 3.60 | 5 | 0.07 |
| 14 | 0.05 | 135 | 3.52 | 5 | 0.06 |
| 15 | 0.05 | 130 | 3.45 | 5 | 0.07 |
| 16 | 0.07 | 126 | 3.30 | 5 | 0.06 |
| 17 | 0.05 | 163 | 3.62 | 5 | 0.12 |
| 18 | 0.05 | 160 | 3.52 | 5 | 0.10 |
| 19 | 0.06 | 152 | 3.45 | 5 | 0.09 |
| 20 | 0.12 | 135 | 3.20 | 4 | 0.09 |
| 21 | 0.04 | 145 | 3.60 | 5 | 0.05 |
| 22 | 0.04 | 142 | 5.52 | 5 | 0.04 |
| 23 | 0.06 | 142 | 3.45 | 5 | 0.04 |
| 24 | 0.08 | 140 | 3.30 | 5 | 0.04 |
| 25 | 0.05 | 150 | 3.60 | 5 | 0.10 |
| 26 | 0.06 | 150 | 3.52 | 5 | 0.09 |
| 27 | 0.08 | 143 | 3.45 | 5 | 0.07 |
| 28 | 0.17 | 130 | 3.20 | 4 | 0.07 |

What is claimed is:

1. A silver halide photographic emulsion comprising silver halide grains, wherein at least 50% of the total grain projected area is accounted for by tabular grains (I) having a chloride content of 50 mol % or more and two parallel (100) major faces, said tabular grains (I) being formed by growing seed grains, said seed grains comprising tabular grains having a bromide content of 50 mol % or more, two parallel (100) major faces and an aspect ratio of 2.0 or more, and a ratio of a mean thickness of said tabular grains (I) to that of said seed grains not exceeding 3.0.

2. The silver halide emulsion of claim 1, wherein said tabular grains (I) have a mean thickness of 0.5 μm and an aspect ratio of 2.0 or more.

3. The silver halide emulsion of claim 1, wherein, said seed grains are reduction-sensitized.

4. The silver halide emulsion of claim 1, wherein said tabular grains (I) have an iodide content of less than 2 mol %.

5. A silver halide photographic emulsion comprising silver halide grains in which at least 50% of the total grain projected area is accounted for by tabular grains (I) having a chloride content of 50 mol % or more and two parallel (100) major faces, said silver halide emulsion being prepared by a process comprising (i) forming a seed grain emulsion comprising tabular grains having a bromide content of 50 mol % or more, two parallel (100) major faces and an aspect ratio of 2.0 or more and (ii) growing the seed grains to form the silver halide emulsion, a ratio of a mean thickness of said tabular grains (I) to that of said seed grains not exceeding 3.0.

6. The silver halide emulsion of claim 5, wherein, in (i), said seed grains are formed by a process comprising:

mixing in a dispersing medium a silver salt and a halide to form nuclear grains, ripening the nuclear grains to form a seed grain emulsion, and subjecting the seed grain emulsion to washing to remove soluble salts.

7. The silver halide emulsion of claim 6, wherein said seed grain emulsion is subjected to reduction sensitization at a time before being subjected to the washing.

8. The silver halide emulsion of claim 7, wherein said seed grain emulsion is reduction-sensitized with a reducing agent, or by ripening the emulsion at a pH of 5 to 11 or a pAg of 1 to 6.

9. The silver halide emulsion of claim 5, wherein said silver halide emulsion is further subjected to sulfur sensitization in combination with selenium or tellurium sensitization.

* * * * *